US006004711A

United States Patent [19]

Bourne et al.

[11] Patent Number: 6,004,711

[45] Date of Patent: Dec. 21, 1999

[54] TONER COMPOSITION INCLUDING POSITIVE AND NEGATIVE TRIBOCHARGING HYDROPHOBIC EXTRA-PARTICULATE ADDITIVES

[75] Inventors: Donald Bourne, Broomfield; Bryan Patrick Livengood, Thornton; Tonya Mira McQueen, Boulder, all of Colo.

[73] Assignee: Lexmark International, Inc., Lexington, Ky.

[21] Appl. No.: 09/243,905

[22] Filed: Feb. 3, 1999

[51] Int. Cl.[6] ..... G03G 9/083

[52] U.S. Cl. ..... 430/106.6; 430/110; 430/111

[58] Field of Search ..... 430/106.6, 108, 430/110, 111

[56] References Cited

U.S. PATENT DOCUMENTS

| | | | |
|---|---|---|---|
| 4,985,327 | 1/1991 | Sakashita et al. | 430/106.6 |
| 5,120,631 | 6/1992 | Kanbayashi et al. | 430/106 |
| 5,202,213 | 4/1993 | Nakahara et al. | 430/110 |
| 5,219,696 | 6/1993 | Demizu et al. | 430/110 |
| 5,296,324 | 3/1994 | Akagi et al. | 430/111 |
| 5,620,823 | 4/1997 | Kambayashi et al. | 430/102 |
| 5,863,691 | 1/1999 | Yamazaki et al. | 430/110 |

OTHER PUBLICATIONS

Degussa Technical Information Sheet, pp. 3, 7, 8, 10, 11 (undated).

*Primary Examiner*—John Goodrow
*Attorney, Agent, or Firm*—John A. Brady

[57] ABSTRACT

Toner compositions comprise (a) a toner particulate including resin, magnetic component and charge control agent, and (b) an extra-particulate additive comprising a first hydrophobic additive having negative tribocharging properties and a second hydrophobic additive having positive tribocharging properties.

23 Claims, No Drawings

TONER COMPOSITION INCLUDING POSITIVE AND NEGATIVE TRIBOCHARGING HYDROPHOBIC EXTRA-PARTICULATE ADDITIVES

FIELD OF THE INVENTION

The present invention is directed to toner compositions for developing electrostatic latent images in electrophotography, electrostatic recording and/or electrostatic printing. More particularly, the present invention is directed to toner compositions which comprise a magnetic toner particulate and both positive and negative tribocharging hydrophobic extra-particulate additives.

BACKGROUND OF THE INVENTION

Numerous methods and apparatus for electrophotography, electrostatic recording and electrostatic printing are known in the art. Typically, a charged photosensitive surface, for example a charged photosensitive drum, is irradiated with an optical image and an electrostatic latent image is formed on the photosensitive surface. In the development process, a developing agent, i.e., toner, is adhered to the electrostatic latent image. Typically, a controlled amount of toner is fed to a developer magnetic roller by a metering blade positioned against the surface of the developing roller. The developer magnetic roller, with the toner on its surface, is typically rotated in a direction opposite to that of the photosensitive drum, and toner adheres to the electrostatic latent image to develop the image. Various toner compositions have been developed in order to provide improved copying, recording and/or printing with such apparatus.

In recent years, there has been a desire to recycle or remanufacture components of commercially available electrostatic copiers, recording devices and printers and particularly to recycle or remanufacture developer cartridges. Generally, the developer cartridges comprise a container for holding toner, a developer magnetic roller and a metering blade for applying an even layer of toner to the roller, and the cartridges are recycled by refilling the container with toner. Oftentimes, the developer magnetic roller in a recycled or remanufactured developer cartridge is worn to some extent so that the surface becomes relatively smooth and/or not sufficiently conductive. Consequently, toner is prevented from moving smoothly and uniformly through the metering blade nip and as a result, "wavy" patterns of toner may form on the developer roller which, in turn, are developed onto the photoconductive drum. Additionally, in some instances, the developer magnetic roller in a recycled or remanufactured developer cartridge is provided with a polymer-based coating to prevent further wear. Typically, the polymer coating which is applied to the developer roller does not have the same properties as the original developer roller surface so that the surface roughness and/or resistivity are altered. As a result, the layer of toner carried on the developer roller will have irregularities which in turn will be evident in the image developed on the photoconductive drum.

Recoated or worn developer magnetic rollers also may exhibit higher resistivities than new developer rollers. As a result, the charge of a layer of toner on the developer roller may be increased as voltage bleed off is prevented. This in turn results in a thin layer of very highly charged toner particles which stick to the recoated or worn developer roller and do not develop onto the drum. The developer roller continues to pick up toner from the hopper; however, the toner is much lower in charge because there is not sufficiently good contact between the second layer of toner and the surface of the developer roller. Consequently, the low charged toner builds up on top of the highly charged toner and creates a wavy pattern on the surface after going through the metering blade nip. Because the second layer of toner is not highly charged, it readily develops onto the drum and then transfers to paper as the aforementioned "wavy" defects.

While many toner compositions are designed for good development in new OEM equipment, oftentimes commercially available toner compositions cannot accommodate the irregularities in the development process caused by recycled or remanufactured developer equipment such as developer cartridges. Accordingly, a need exists for toner compositions which not only provide good development in new electrostatic copying, recording and printing apparatus but are also capable of providing good development when employed in recycled or remanufactured developer cartridges in such apparatus.

Typically, extra-particulate additives are combined with toner particulates in order to improve selected properties of the toner particulates including transferability, cleaning properties, flowability and the like, as taught, for example, in the Akagi et al U.S. Pat. No. 5,296,324 and the Kanbayashi et al U.S. Pat. No. 5,120,631. It has also been suggested to lower the chargeability (tribocharge) of toner compositions in order to improve transferability, cleaning properties, flow problems and the like. However, print quality problems, including low optical density and high CAD, often result. Accordingly, there is a continuing need for improving toner compositions.

SUMMARY OF THE INVENTION

Accordingly, it is an object of the present invention to provide improved toner compositions. It is a related object of the present invention to provide improved toner compositions which are suitable for use in new electrostatic copying, recording and/or printing apparatus and in electrostatic copying, recording and/or printing apparatus which employ recycled or remanufactured parts, including recycled or remanufactured developer cartridges.

These and additional objects are provided by the toner compositions of the present invention which comprise (a) a toner particulate including resin, a magnetic component and charge control agent, and (b) an extra-particulate additive. The extra particulate additive comprises a first hydrophobic additive having negative tribocharging properties and a second hydrophobic additive having positive tribocharging properties. Preferably, the toner composition has a moderately high negative charge whereby good development of electrostatic latent images can be obtained without wavy patterns in the developed image, regardless of the quality of the developer roller.

These and additional objects and advantages provided by the toner compositions according to the present invention will be more fully understood in view of the following detailed description.

DETAILED DESCRIPTION

The toner compositions of the present invention comprise a toner particulate and an extra-particulate additive. The toner particulate is prepared in accordance with methods generally known in the toner art and comprises resin, a magnetic component, and a charge control agent. These components are kneaded with one another, pulverized and typically classified to provide toner particles of a desired size, typically from about 1 to about 50 μm, and more preferably from about 1 to about 25 μm, and even more preferably from about 6 to about 10 μm.

The resin typically serves as a binder agent and may be any resin known in the art for use in toner compositions. Examples of suitable resins include, but are not limited to, acrylic resins, styrene resins, polyester resins, epoxy resins, phenolic resins, polyamide resins, ethylene polymers, copolymers of these polymer resins, and the like. Preferably, the resin comprises an acrylic resin, a styrene resin or a mixture thereof. Suitable styrene resins include homopolymers of styrene and its derivatives, including alkyl, halo and/or aryl-substituted styrenes, for example poly-p-chlorostyrene, polyvinyltoluene, and polymethylstyrene, and copolymers of styrene and one or more additional monomers. Examples of comonomers for use in such styrene copolymers include vinyl monomers such as monocarboxylic acids having a double bond and substituted derivatives thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and substituted derivatives thereof, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; and vinyl ethers, such as vinyl methyl ether, vinyl ethyl ether, and vinyl isobutyl ether, used singly or in combinations of two or more with a styrene monomer. Suitable acrylic resins include acrylic and acrylate homopolymers, methacrylic and methacrylate homopolymers, acrylic and acrylate copolymers and methacrylic and methacrylate copolymers. These resins for use in the toner particulate typically include a crosslinking agent in an amount of from about 0.01 to about 5 parts by weight per 100 parts by weight of the monomers employed therein.

The resin is included in the toner particulate in an amount sufficient to provide binding ability and preferably is included in amount of from about 40 to about 80 weight percent, more preferably from about 50 to about 70 weight percent, based on the weight of the toner particulate.

The magnetic component included in the toner particulate may comprise any magnetic pigment, metal oxide or mixture thereof known in the art and typically employed in toner particulates. Iron oxides such as magnetic, hematite, ferrite, and modified forms of such oxides are preferred. Other magnetic components suitable for use herein include metals such as iron, cobalt, nickel and alloys of these metals with one another and/or with other metals. The magnetic component is included in the toner particulate in an amount of from about 20 to about 60 weight percent, more preferably from about 30 to about 50 weight percent, based on the weight of the toner particulate.

The toner particulate further includes one or more charge control agents which contribute to stabilize the charge characteristics of the toner composition. In accordance with the present invention, the toner composition preferably is a negatively charged toner. Negative-charge control agents include, but are not limited to, organic metal complexes or chelates such as a chromium, zinc, iron or aluminum complex of an organic compound. Complexes or chelates of organic acids, azo compounds and the like are also suitable. Further examples of the charge control agent include quaternary ammonium salts, various electron attractive/donative inorganic powders, inorganic materials surface treated with a polar material, polar polymer beads and the like. The charge control agent is included in the toner particulate in an amount sufficient to stabilize the charge characteristics, and preferably in an amount of from about 0.1 to about 10 weight percent, more preferably from about 0.25 to about 5 weight percent, based on the weight of the toner particulate.

The toner particulate may include additional conventional additives known in the art. For example, and in accordance with a preferred embodiment, the toner particulate includes a release agent, for example a wax release agent. Suitable waxes include low molecular weight polyethylene, low molecular weight polypropylene, microcrystalline wax, carnauba wax, and paraffin wax. Generally, these waxes are included in amounts up to about 5 weight percent, based on the weight of the toner particulate. Additional conventional additives include dyes, pigments and other colorants which may be included in customary amounts in the toner particulate.

In accordance with an important feature of the toner compositions of the invention, the extra-particulate additive comprises a first hydrophobic additive having negative tribocharging properties and a second hydrophobic additive having positive tribocharging properties. Preferably, the toner composition is negatively charged, whereby the additive particles having negative tribocharging properties are included in an amount greater than that of the additive particles having positive tribocharging properties. Conversely, if a toner composition having a positive charge is desired, the additive particles having positive tribocharging properties are included in an amount greater than that of the additive particles having negative tribocharging properties.

The extra-particulate additive particles may be of any composition and suitable examples include silica, alumina and/or titania particles, as long as the particles exhibit the desired hydrophobic character and the respective negative or positive charge characteristics. Preferably, at least one of the first and second hydrophobic additives comprises hydrophobic silica. In one embodiment, one of the hydrophobic additives comprises silica while the other of the hydrophobic additives comprises an additive other than silica, for example alumina or titania. In another embodiment, both the first and second hydrophobic additives comprise silica, one of which has been treated to have a negative charge and the other of which has been treated to have a positive charge.

The extra-particulate additives which are employed in the toner compositions may be prepared by any method known in the art. In a preferred embodiment, the extra-particulate additives comprise a fumed silica produced by gaseous phase oxidation of a silicon halogenide, for example, silicon tetrachloride. The silica may be dual treated in that it is subjected to one treatment which renders it hydrophobic (to prevent various extreme environmental conditions from adversely effecting the triboelectric charging properties of the toner) and to another treatment which provides the desired positive or negative tribocharging properties. As one skilled in the art will appreciate, hydrophobicity generally describes the ability of the additive to resist moisture pick up or absorption. Typically, the hydrophobic additives employed in the present invention will absorb less than about 2 weight percent of moisture when stored under conditions of 25° C. and 80% relative humidity for a period of about 2 to 3 hours, based on the weight of the additive. One skilled in the art will further appreciate the tribocharging properties of the additive describe the charge characteristic which the additive will contribute to the toner in use. Generally, tribocharging levels (electrostatic charge levels) are dependent on the method employed for measurement. In one conventional method, the additive is mixed with ferrite carrier under conditions of 25° C. and 45% relative humidity for an activation period of, for example, 30 seconds to several minutes, after which the charge of the mixture is measured using the conventional blow off method with nitrogen gas.

While various methods are known in the art for treating silica or other extra-particulate additive to render it hydrophobic, in a preferred embodiment, the silica or other extra-particulate additive is chemically treated with an organic silicon compound capable of reacting with or being physically adsorbed on the silica. Examples of organic silicon compounds suitable for rendering the silica or other extra-particulate additive hydrophobic include, but are not limited to, hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans, e.g., trimethylsilylmercaptan, triorganosilylacrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, γ-aminopropyl triethoxysilane and polydimethylsiloxane. These may be used alone or in combination. A preferred organic silicon compound for rendering silica additives hydrophobic comprises hexamethyldisilazane.

Each of the first and second extra-particulate additives are treated to provide the respective tribocharging characteristics. Preferably, in the embodiment wherein both of the first and second additives are silica, the silicas included in the toner compositions of the present invention are dual treated. That is, in addition to the hydrophobic treatment described above, hydrophobic silica is subjected to treatment which provides the silica with negative tribocharging properties or is subjected to treatment which provides the silica with positive tribocharging properties.

One skilled in the art will readily appreciate compounds which may be used in order to impart negative tribocharging properties to the first hydrophobic additive. In a preferred embodiment, the first hydrophobic additive is treated with a silane compound or a siloxane compound in order to provide the negative tribocharge characteristic. Examples of suitable silane and siloxane compounds include those set forth above in the discussion of the hydrophobic treatment. Preferred compounds for providing the first hydrophobic additive with negative tribocharging properties comprise polysiloxanes having aryl and/or alkyl substitution, with dialkylpolysiloxanes such as polydimethylsiloxane being particularly preferred.

One skilled in the art will also readily appreciate compounds which may be used to provide the second hydrophobic additive with positive tribocharge characteristics. Preferred compounds for providing the positive tribocharge characteristic comprise silicone oils having a nitrogen atom in a side chain, for example in the form of an amino group or an organic group having at least one amino group or nitrogen atom therein. Examples of such compounds include, but are not limited to, aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethylmethoxysilane, dibutylaminopropyldiethylmonomethoxysilane, dimethylaminophenyltriethoxysilane, trimethoxysilyl-γ-propylphenylamine, and trimethoxysilyl-γ-propylmorpholine.

One skilled in the art will readily appreciate that the first and second extra-particulate additives may also be provided with their respective tribocharging properties by means other than the coatings described herein, in accordance with the techniques known in the art.

The first and second hydrophobic additives having negative and positive tribocharging properties, respectively, may be employed in various ratios to provide the toner composition with a desired overall triboelectric charge. In a preferred embodiment, the first hydrophobic additive having negative tribocharging properties is employed in an amount greater than the second hydrophobic additive having positive tribocharging properties, whereby the toner composition exhibits an overall negative triboelectric charge. More preferably, the first hydrophobic additive having negative tribocharging properties and the second hydrophobic additive having positive tribocharging properties are employed in a weight ratio of from about 1:1 to about 20:1, and more preferably in a weight ratio of from about 2:1 to about 10:1.

The extra-particulate additive particles may be of any suitable size. In a preferred embodiment, particularly wherein the additives comprise silica, the additives have an average primary particle size of from about 5 to about 20 nm or an average BET surface area of from about 150 $m^2/g$ to about 350 $m^2/g$.

The extra-particulate additive is employed in the toner compositions in an amount sufficient to provide the desired overall triboelectric charge to the toner composition. Suitably, the toner compositions according to the invention comprise from about 95 to about 99.9 weight percent of the toner particulate and from about 0.1 to about 5 weight percent of the extra-particulate additives, based on the weight of the toner compositions. More preferably, the toner compositions comprise from about 97.5 to about 99.9 weight percent of the toner particulate and from about 0.1 to about 2.5 weight percent of the extra-particulate additive, based on the weight of the toner composition. In preferred embodiments of the present invention, the hydrophobic silica having negative tribocharging properties is employed in the toner compositions in an amount of from about 0.3% to about 1.5% by weight of the toner composition and more preferably in an amount of from about 0.4% to about 1.2% by weight, based on the weight of the toner composition. In further embodiments, the hydrophobic silica having positive tribocharging properties is employed in an amount of from about 0.04% to about 0.4% by weight, based on the toner composition, and more preferably is employed in an amount of from about 0.05% to about 0.3% by weight based on the toner composition. In addition to the toner particulate and the described extra-particulate additives, the toner compositions may further include additional extra-particulate additives and/or conventional toner components in conventional amounts. Examples of such additives and components include, but are not limited to, zinc stearate, abrasives, microspheres, and the like.

To prepare the toner compositions of the present invention, the components of the toner particulate are thoroughly mixed using a mixing machine such as a blender. Suitable blenders comprise conical blenders, Henschel blenders, Waring blenders and the like. The resulting mixture is melted, kneaded and milled using a heat roller, a kneader and/or an extruder. The resulting dispersion is cooled, solidified and then pulverized, followed by classification. The toner particulate and the extra-particulate additive comprising the two types of hydrophobic additives are then thoroughly mixed.

The toner compositions according to the present invention will be further illustrated in the following examples. Throughout the examples and the present specification, parts and percentages are by weight unless otherwise specified.

The resulting toner compositions were included in after-market cartridges employing developer magnetic sleeves which were prone to exhibit "wave patterns." Each cartridge was equilibriated at 60° F. and 8% relative humidity for at least 24 hours and then placed in an electrostatic printer. The "wavy pattern" characteristics of the resulting printed pages were evaluated by printing two print sets, each of which comprised all black sheets, all white sheets, sheets with graphics and sheets with text (about 10 pages per print set). The level of waves on the resulting printed pages were compared with a standard print set and ranked from 0 to 5, 0 representing that no print quality defects known as waves were detected and 5 indicating significant "wave patterns" were observed. The rankings and print quality of the pages are also set forth in Table 1.

TABLE 1

| Composition | Toner Particulate, wt % | −Tribocharging Silica, wt % | +Tribocharging Silica, wt % | Wt Ratio, −/+ Silica | Wave Pattern | Optical Density Print Quality |
|---|---|---|---|---|---|---|
| 1A | 99.2 | 0.6 | 0.07 | 8.6 | 0 | 1.44 |
| 1B | 99.2 | 0.6 | 0.10 | 6.0 | 0 | 1.37 |
| 1C | 99.2 | 0.6 | 0.13 | 4.6 | 0 | 1.31 |
| 1D | 99.1 | 0.75 | 0.07 | 10.7 | 5 | 1.40 |
| 1E | 99.1 | 0.75 | 0.10 | 7.5 | 0 | 1.40 |
| 1F | 99.0 | 0.75 | 0.13 | 5.8 | 0 | 1.29 |
| 1G | 98.9 | 0.9 | 0.07 | 12.9 | 3.5 | 1.45 |
| 1H | 98.9 | 0.9 | 0.10 | 9 | 4 | 1.43 |
| 1I | 98.9 | 0.9 | 0.13 | 6.9 | 0 | 1.28 |

EXAMPLE 1

In this example, toner compositions 1A–1I were prepared comprising a toner particulate and an extra-particulate additive. The toner particulate comprised, by weight of the toner particulate, about 57.8% of crosslinked styrene-acrylic copolymer resin, about 40% of an iron oxide, about 0.8% of a charge control agent comprising an organo-chromium complex and about 1.5% of a wax release agent comprising a low molecular weight polypropylene. These components were mixed, kneaded, cooled and pulverized to form the toner particulate. The toner particulate had an average particle size of about 8 $\mu$m. The extra-particulate additive of each toner composition comprised both a hydrophobic silica having negative tribocharging properties and a hydrophobic silica having positive hydrocharging properties. The weight percentages of the hydrophobic silicas and the toner particulate for each composition are set forth in Table 1. The negative tribocharging silica comprised fumed silica post-treated with both hexamethyldisilazane and polydimethylsiloxane and exhibited relatively high negative tribocharging properties. This allows the toner composition to which it is added to employ less charge control agent, which is an expensive component, while maintaining adequate toner tribocharging for good optical density and low background. The positive tribocharging silica comprised fumed silica treated with hexamethyldisilazane to render the silica hydrophobic and with $\alpha$-aminopropyltriethoxysilane to provide it with positive tribocharging properties. Each composition also included about 0.1 weight percent of a negative charging polymer microsphere.

From the results set forth in Table 1, it appears that as the level of positively-tribocharged silica increases, the wave patterns are decreased and eventually disappear, although with some sacrifice of optical density. Conversely, as the level of negative tribocharging silica increases at a constant positive tribocharging silica level, the wave pattern increases. Similar results were obtained using toner compositions as described herein which omitted the microsphere component. Thus, the toner compositions can be optimized to suppress the wave pattern while maintaining good optical density.

EXAMPLE 2

In this example, a toner particulate and 0.1 weight percent of negative charging polymer microspheres substantially as described in Example 1 were combined with various proportions of negative tribocharging hydrophobic silica and positive tribocharging hydrophobic silica substantially as described in Example 1 to provide compositions 2A–2G as set forth in Table 2. The toners were employed in electrostatic printers and the resulting printed pages were evaluated according to the procedures described in Example 1. The results of these evaluations are also set forth in Table 2.

TABLE 2

| Composition | Toner Particulate, wt % | −Tribocharging Silica, wt % | +Tribocharging Silica, wt % | Wt Ratio, −/+Silica | Wave Pattern | Optical Density Print Quality |
|---|---|---|---|---|---|---|
| 2A | 99.3 | 0.57 | 0.08 | 7.1 | 2 | 1.42 |
| 2B | 99.2 | 0.57 | 0.10 | 5.7 | 0 | 1.41 |
| 2C | 99.2 | 0.57 | 0.12 | 4.8 | 0 | 1.38 |
| 2D | 99.2 | 0.67 | 0.08 | 8.4 | 2 | 1.41 |
| 2E | 99.1 | 0.67 | 0.10 | 6.7 | 0 | 1.43 |
| 2F | 99.1 | 0.67 | 0.12 | 5.6 | 0 | 1.39 |
| 2G | 99.1 | 0.77 | 0.08 | 9.6 | 0 | 1.45 |
| 2H | 99.0 | 0.77 | 0.10 | 7.7 | 0 | 1.41 |
| 2I | 99.0 | 0.77 | 0.12 | 6.4 | 0 | 1.41 |

Similar results were obtained using toner compositions as described herein which omitted the microsphere component.

EXAMPLE 3

This example demonstrates that the toner compositions according to the present invention also exhibit good powder flow, particularly as compared with toner compositions which contain a negative tribocharging silica but omit a positive tribocharging silica. In toner compositions 3A–3E of this example, a toner particulate and 0.1 weight percent of negative charging microspheres substantially as described in Example 1 were combined with extra-particulate additive. Specifically, silica having negative tribocharging properties as described in Example 1 was employed in the toner compositions of this example while silica having positive tribocharging properties as described in Example 1 was employed in compositions 3B–3E. The amount of the toner powder flowing through a 75 $\mu$m screen was determined. As set forth in Table 3, the toner compositions 3B–3E exhibited significantly improved flow as compared with the comparative toner composition 3A. Thus, the use of both negative tribocharging hydrophobic additive and positive tribocharging hydrophobic additive provides toner compositions having good powder flow properties.

TABLE 3

| Composition | −Tribocharging Silica, wt % | +Tribocharging Silica, wt % | Powder Flow, wt %, thru 75 $\mu$m screen |
|---|---|---|---|
| 3A | 0.80 | — | 40–50 |
| 3B | 0.60 | 0.11 | 97.9 |
| 3C | 0.60 | 0.13 | 95.3 |
| 3D | 0.70 | 0.11 | 93.2 |
| 3E | 0.70 | 0.13 | 97.4 |

Similar results were obtained using toner compositions as described herein which omitted the microsphere component.

EXAMPLE 4

This example demonstrates that toner compositions according to the present invention which contain a negative tribocharging silica and a positive tribocharging titania or alumina also exhibit good powder flow. In toner compositions 4A–4K of this example, the toner particulate and extra-particulate hydrophobic silica having negative tribocharging properties as described in Example 1 were combined with an extra-particulate hydrophobic titania having positive tribocharging properties, in the amounts set forth in Table 4. In toner composition 4L, the toner particulate and hydrophobic negative tribocharging silica described in Example 1 were combined with an extra particulate hydrophobic alumina having positive tribocharging properties, in the amounts set forth in Table 4. As also indicated in Table 4, several of the compositions also contained microspheres as described in Example 1. The amount of the toner powder flowing through a 75 $\mu$m screen was determined for each composition. As set forth in Table 4, the toner compositions of Examples 4A, 4D–4G and 4L exhibited particularly good flow, particularly as compared with the comparative toner composition of Example 3A. Although the flow properties of compositions 4B, 4C, 4H and 4I were not significantly improved, these compositions exhibited good print quality when used in aftermarket cartridges. Thus, the use of both negative tribocharging hydrophobic silica additive and positive tribocharging hydrophobic titania or alumina additive provides toner compositions having good properties for aftermarket applications.

TABLE 4

| Composition | −Tribocharging Silica, wt % | +Tribocharging Titania (4A-4K) or Alumina (4L), wt % | Microspheres, wt % | Powder Flow, wt %, thru 75 $\mu$m screen |
|---|---|---|---|---|
| 4A | 0.4 | 0.4 | 0.1 | 86 |
| 4B | 0.5 | 0.15 | — | 40.4 |
| 4C | 0.75 | 0.15 | — | 53.0 |
| 4D | 0.5 | 0.3 | — | 79.0 |
| 4E | 0.75 | 0.3 | — | 93.2 |
| 4F | 0.5 | 0.3 | 0.1 | 93.5 |
| 4G | 0.75 | 0.3 | 0.1 | 97.2 |
| 4H | 0.6 | 0.2 | 0.1 | 38.3 |
| 4I | 0.6 | 0.25 | 0.1 | 45.8 |
| 4J | 0.7 | 0.2 | 0.1 | 55.8 |
| 4K | 0.7 | 0.25 | 0.1 | 67.5 |
| 4L | 0.5 | 0.3 | 0.1 | 97.9 |

The examples and specific embodiments set forth in the present specification are provided to illustrate the toner compositions of the invention and are not intended to be limiting thereof. Additional embodiments within the scope of the claimed invention will be apparent to those of ordinary skill in the art.

What is claimed is:

1. A toner composition, comprising (a) a toner particulate including resin, a magnetic component, and a charge control agent, and (b) an extra-particulate additive comprising a first hydrophobic additive having negative tribocharging properties and a second hydrophobic additive having positive tribocharging properties.

2. A toner composition according to claim 1, wherein the toner particulate comprises at least one resin selected from the group consisting of acrylic resins, styrene resins, and mixtures thereof.

3. A toner composition according to claim 2, wherein the toner particulate comprises a styrene-acrylic copolymer resin.

4. A toner composition according to claim 1, wherein the magnetic component comprises at least one iron oxide.

5. A toner composition according to claim 1, wherein the charge control agent comprises an organic metal complex negative charge control agent.

6. A toner composition according to claim 1, wherein the toner particulate comprises from about 40 to about 80 weight percent of the resin, from about 20 to about 60 weight percent of the magnetic component and from about 0.1 to about 10 weight percent of the charge control agent, based on the weight of the toner particulate.

7. A toner composition according to claim 1, comprising from about 95 to about 99.9 weight percent of the toner particulate and from about 0.1 to about 5 weight percent of the extra-particulate additive, based on the weight of the toner composition.

8. A toner composition according to claim 1, comprising from about 97.5 to about 99.9 weight percent of the toner particulate and from about 0.1 to about 2.5 weight percent of the extra-particulate additive, based on the weight of the toner composition.

9. A toner composition according to claim 1, wherein the extra-particulate additive comprises the first hydrophobic additive having negative tribocharging properties and the second hydrophobic additive having positive tribocharging properties in a weight ratio of from about 1:1 to about 20:1.

10. A toner composition according to claim 9, wherein the extra-particulate additive comprises the first hydrophobic additive having negative tribocharging properties and the second hydrophobic additive having positive tribocharging properties in a weight ratio of from about 2:1 to about 10:1.

11. A toner composition according to claim 1, wherein at least one of the first and second hydrophobic additives comprise hydrophobic silica.

12. A toner composition according to claim 11, wherein the first hydrophobic additive comprises negative tribocharging silica.

13. A toner composition according to claim 11, wherein the second hydrophobic additive comprises positive tribocharging silica.

14. A toner composition according to claim 12, wherein the second hydrophobic additive comprises positive tribocharging silica.

15. A toner composition according to claim 11, wherein the other of the first and second hydrophobic additives comprises hydrophobic titania or alumina.

16. A toner composition according to claim 14, wherein the first hydrophobic silica having negative tribocharging properties and the second hydrophobic silica having positive tribocharging properties have been rendered hydrophobic by treatment with hexamethyldisilazane.

17. A toner composition according to claim 1, wherein the toner particulate further comprises a wax release agent.

18. A toner composition, comprising (a) from about 95 to about 99.9 weight percent of a toner particulate including at least one resin selected from the group consisting of acrylic resins and polystyrene resins, a magnetic component, and charge control agent, and (b) from about 0.1 to about 5 weight percent of an extra-particulate additive comprising a first hydrophobic additive having negative tribocharging properties and a second hydrophobic additive having positive tribocharging properties in a weight ratio of from about 2:1 to about 10:1.

19. A toner composition according to claim 18, comprising from about 97.5 to about 99.9 weight percent of the toner particulate and from about 0.1 to about 2.5 weight percent of the extra-particulate additive.

20. A toner composition according to claim 19, wherein at least one of the first and second hydrophobic additives comprises hydrophobic silica.

21. A toner composition according to claim 20, wherein both of the first and second hydrophobic additives comprise silica.

22. A toner composition according to claim 20, wherein the first hydrophobic additive comprises a negative tribocharging silica and the second hydrophobic additive comprises a positive tribocharging titania or alumina.

23. A toner composition according to claim 17, wherein the toner particulate comprises from about 40 to about 80 weight percent of the resin, from about 20 to about 60 weight percent of the magnetic component, and from about 0.1 to about 10 weight percent of the charge control agent, based on the weight of the toner particulate.

* * * * *